US006029587A

United States Patent [19]

Rozier, Jr. et al.

[11] Patent Number: 6,029,587

[45] Date of Patent: Feb. 29, 2000

[54] OFFSET SUPPORT LEG FOR AN ADJUSTABLE HEIGHT DESK

[75] Inventors: Charles P. Rozier, Jr., Fairfield County, Conn.; Michael L. McAllister, Montgomery County, Pa.

[73] Assignee: Knoll, Inc., East Greenville, Pa.

[21] Appl. No.: 09/092,518

[22] Filed: Jun. 5, 1998

[51] Int. Cl.[7] ..... A47B 9/00

[52] U.S. Cl. ..... 108/147.21; 108/50.02; 108/155; 312/223.6

[58] Field of Search ..... 108/147.19, 147, 108/147.21, 155, 156, 158, 187, 50.02; 248/188, 188.5; 312/223.6

[56] References Cited

U.S. PATENT DOCUMENTS 3,367,290 2/1968 Barecki .
3,866,549 2/1975 Berton .
4,287,837 9/1981 Bayles .
4,745,867 5/1988 Niemiec .
4,884,513 12/1989 Newhouse et al. .
5,394,809 3/1995 Feldpausch et al. ..... 108/147.21
5,490,466 2/1996 Diffrient .
5,638,759 6/1997 Klugkist .
5,640,912 6/1997 Diffrient .

*Primary Examiner*—Anthony Knight
*Assistant Examiner*—Karlena D. Schwing
*Attorney, Agent, or Firm*—Buchanan Ingersoll, P.C.

[57] ABSTRACT

An offset cantilevered support leg for a height adjustable desk which resists lateral forces is provided. Each support leg is connected to the underside of the desk top at the lateral ends thereof by an L-shaped bracket. A primary support arm provides the cantilevered support for the desk top while a secondary support arm, angularly offset from and generally oriented perpendicularly with respect to the primary support arm, provides support against lateral forces directed against the legs. By orienting each of the respective support arms of the L-shaped bracket with the rear corners of the work surface, the legs provide adequate support against vertical and horizontal loading while maximizing the available space underneath the desk, and thus eliminating the need for a horizontal stretcher between the cantilevered support leg.

19 Claims, 5 Drawing Sheets

OFFSET SUPPORT LEG FOR AN ADJUSTABLE HEIGHT DESK

BACKGROUND OF THE INVENTION

1. Field of the Invention

The present invention relates to a freestanding adjustable height desk, and more particularly to an offset cantilevered support arm for an adjustable height desk having a right angle attachment bracket for connecting the leg to the work surface.

2. Description of the Prior Art

In modern office furniture, it is common to have an adjustable height work surface which can accommodate the varying needs of different users. In such a system, typically the vertical legs supporting the work surface are height adjustable such as by one member being slidably connected to a second member which is rigidly attached to the horizontal foot portion which rests on the floor. It is important that the bracket which attaches the work surface or desk top to the height adjustable legs be able to support the desk top as well as the weight of any equipment which is placed thereon, such as computers and the like. In addition to supporting the weight of the equipment on the work surface, the support for the table must also conform to certain industry and safety standards required for office equipment.

For example, the strength of the attachment between the leg and a desk top must be sufficient enough such that, when the desk is tilted at a 45° angle on one leg, the desk top does not become separated from the legs. For example, the screws which attach the leg to the desk top should not strip out from the work surface due to the lateral forces. Additionally, another safety test that must be satisfied is the application of a 150 pound side force on the bottom of a support leg, which force is directed inward with respect to the desk. Again, the connection between the table top and the support leg must be of sufficient strength to prevent the lateral forces which are acting on the support leg from causing the desk top to become separated from the support legs. Thus, the support legs must be able to withstand not only the vertical pressure from the weight of the desk top and the equipment placed thereon, but also lateral forces which are typically directed on the work surface and its associated support legs in a normal work place environment.

With a cantilevered C-leg support commonly found in the prior art, a typical means of counteracting these lateral forces imposed on the support legs is by attachment of a brace or other support which rigidly connects the two support legs to each other. This is shown in FIG. 1. In this manner, a horizontal support or brace which spans across the horizontal space underneath the desk top rigidly attaches the two vertical support legs together such that lateral forces acting on one leg can be shared by the opposite leg. Also, weight placed on top of the table cannot force the legs to splay outward since the legs have been rigidly connected by the brace. For a height adjustable desk, the brace is connected between the rigid or non-moving portions of the height adjustment mechanism. Thus, if the brace is also to be used as part of a wire management system, the separation between the desk top and the support brace as it is raised must be taken into account when laying in wires. In this manner, conventional work surfaces have their support legs rigidly connected to counteract these lateral forces or other forces which tend to cause the legs to become separated from the bottom of the work surface.

It is also common to place pedestals having desk drawers or other work space accessories underneath the work surface for convenient use by the person working at the desk. Thus, file cabinets and the like are generally arranged in a pedestal which must fit in the space underneath the desk within the confines of the support legs and brackets. For this reason, it is common for the C-leg support to be a relatively narrow cantilever arm which projects forward. This cantilever arm allows the support legs to be placed towards the back of the tabletop such that clearance for knee swing between adjacent desks is provided. The brace is commonly placed along the back edge of the desk spanning from one leg to the other for maximum knee and pedestal clearance under the front of the desk. Alternatively, a diagonal brace may be connected between a lower portion of the legs and the underside of the desk top toward the middle of the work surface. Although the arrangement can provide the necessary lateral support, it presents certain drawbacks. Since the support brace is generally exposed in a typical open office environment, the brace must be given a decorative finish so as to present an aesthetically pleasing appearance. This adds to the cost and complexity of producing the brace, and hence of the complete desk. And because the horizontal brace is disposed towards the back edge of the desk, it limits the space underneath the desk in that area. Thus, an obstruction is created, for example, when a person wants to sit at the other side of the desk such as when an office visitor pulls up a chair. While a wide cantilever support arm can be used instead, this would further reduce the available area underneath the desk for storage and knee space.

What is needed then is a means of supporting a work surface with a height adjustable leg support which obviates the need for a lateral brace spanning the distance between the opposite support legs.

It is therefore an object of the present invention to provide a relatively narrow support leg and bracket assembly for a height adjustable desk in which the desk is fully supported both vertically and horizontally against lateral forces acting on the leg supports by a bracket which connects each leg to the tabletop without the use of a brace.

It is another object of the present invention to provide a support for a desk top which maximizes the available space underneath the work surface while minimizing the number of elements and cost of the desk assembly.

It is yet another object of the present invention to provide a lateral support for desk legs which provides greater leg access from both the front and rear of the desk.

It is a still further object of the present invention to provide an offset support leg for an adjustable height work surface which minimizes the components necessary to connect the leg to the desk so as to provide for ease of set up and requires fewer parts for shipping.

SUMMARY OF THE INVENTION

The above objects are attained by the present invention, according to which, briefly stated, a desk having a substantially rectangular work surface and two supporting leg assemblies is provided. Each of the supporting leg assemblies is located adjacent each lateral end of the work surface and comprises a cantilevered support leg for the work surface. The cantilevered support leg includes a foot which rests on the floor at two widely spaced points, and a vertical leg having a height adjustable or vertically adjustable arrangement for adjusting the height of the work surface relative to the floor. A cantilevered support bracket attaches each support leg at its uppermost end to the underside of the work surface. Each support bracket further comprises an L-shaped member having a primary support arm, and a secondary support arm connected at one end and angularly offset with respect to each other. Preferably, the secondary support arm extends generally perpendicularly from the primary support arm. The L-shaped support brackets are positioned under the work surface such that the primary support arm is generally parallel to the desk top side edges and the secondary support arm is oriented substantially parallel with the back edge of the work surface. In this way the width and depth of the unobstructed area under the work surface is maximized to allow the placement of office accessories thereunder.

The present invention is also embodied in a cantilevered support leg for a desk having an improved attachment bracket in which secondary support arms are provided for the attachment bracket for attaching the support leg to the tabletop. Secondary support arms extend generally perpendicularly with respect to the cantilevered support leg for providing an offset lateral support to the legs relative to the work surface. Alternatively, a third member can be attached to the bottom of the work surface, which third member rigidly connects each of the cantilevered attachment brackets so as to generally provide a U-shaped support on the bottom of the work surface in order to further buttress the desk top support.

BRIEF DESCRIPTION OF THE DRAWINGS

Various other objects, features and advantages of the invention are more apparent by reading the following detailed description in conjunction with the drawings, as shown by way of example only, wherein.

DETAILED DESCRIPTION OF THE PREFERRED EMBODIMENTS

Figure 1:
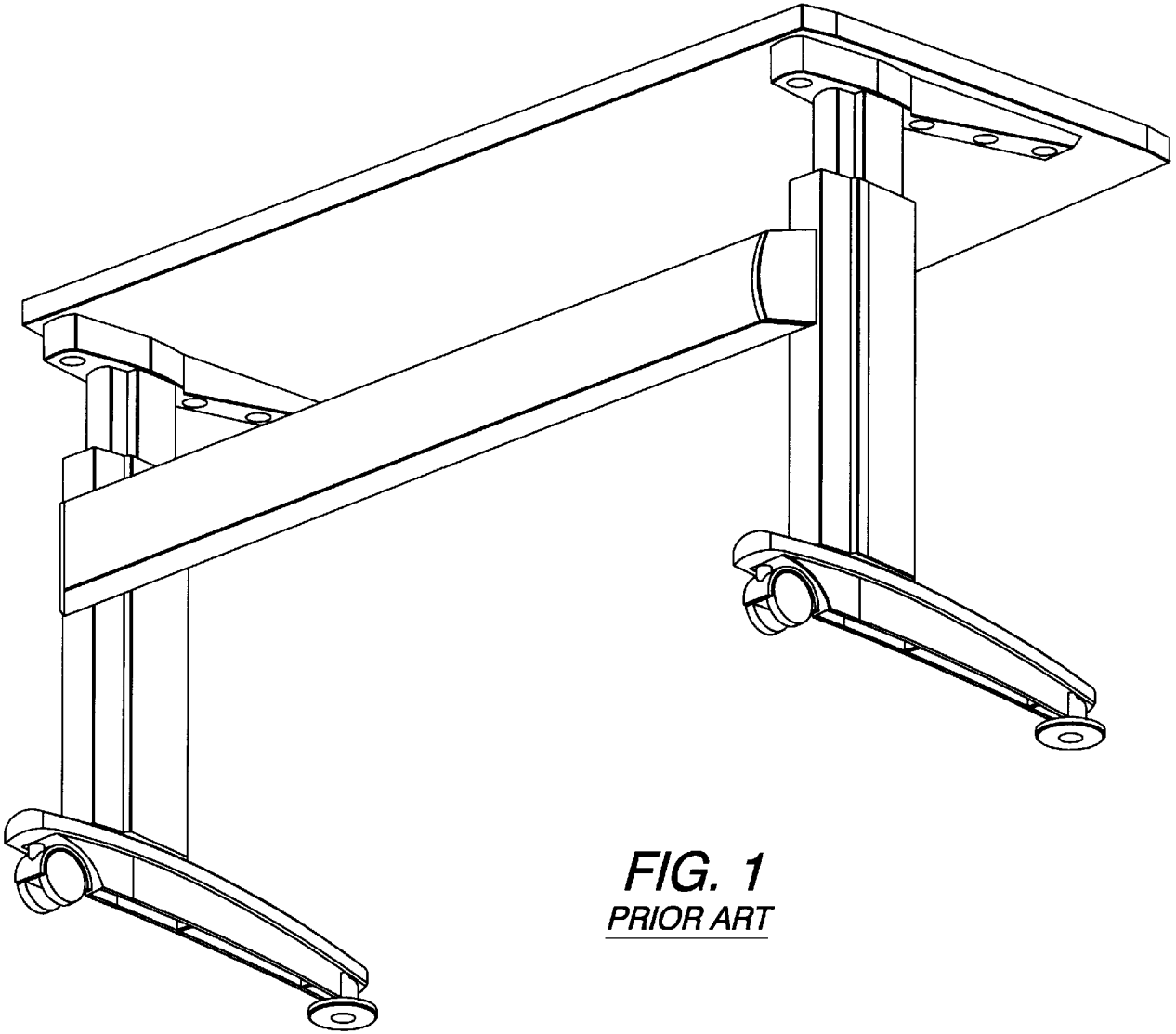
FIG. 1 PRIOR ART
FIG. 1 shows a typical support for a desk top according to the prior art.
Figure 2:
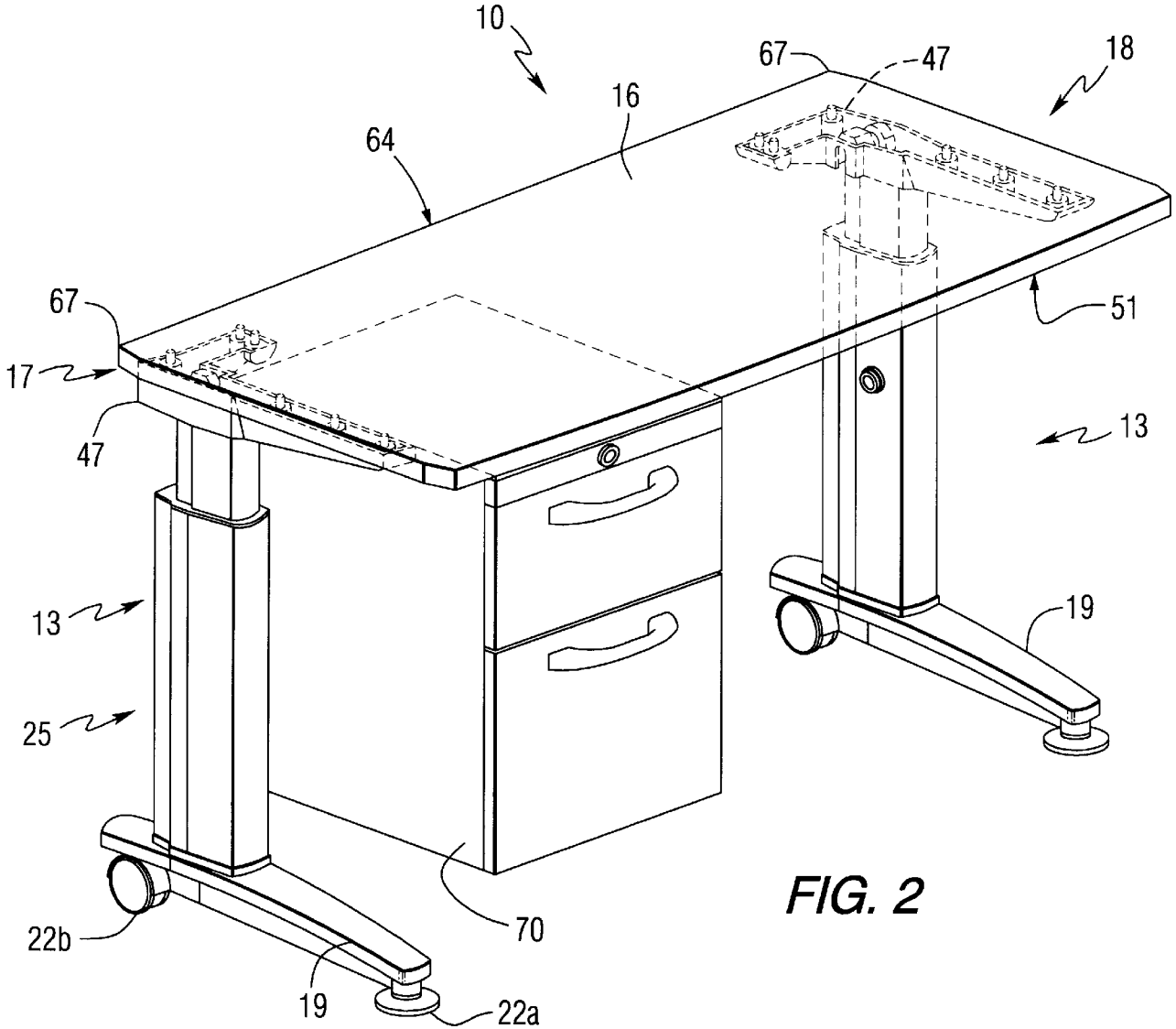
FIG. 2 is a perspective view of a desk having a cantilevered support leg according to the present invention.
Figure 3:
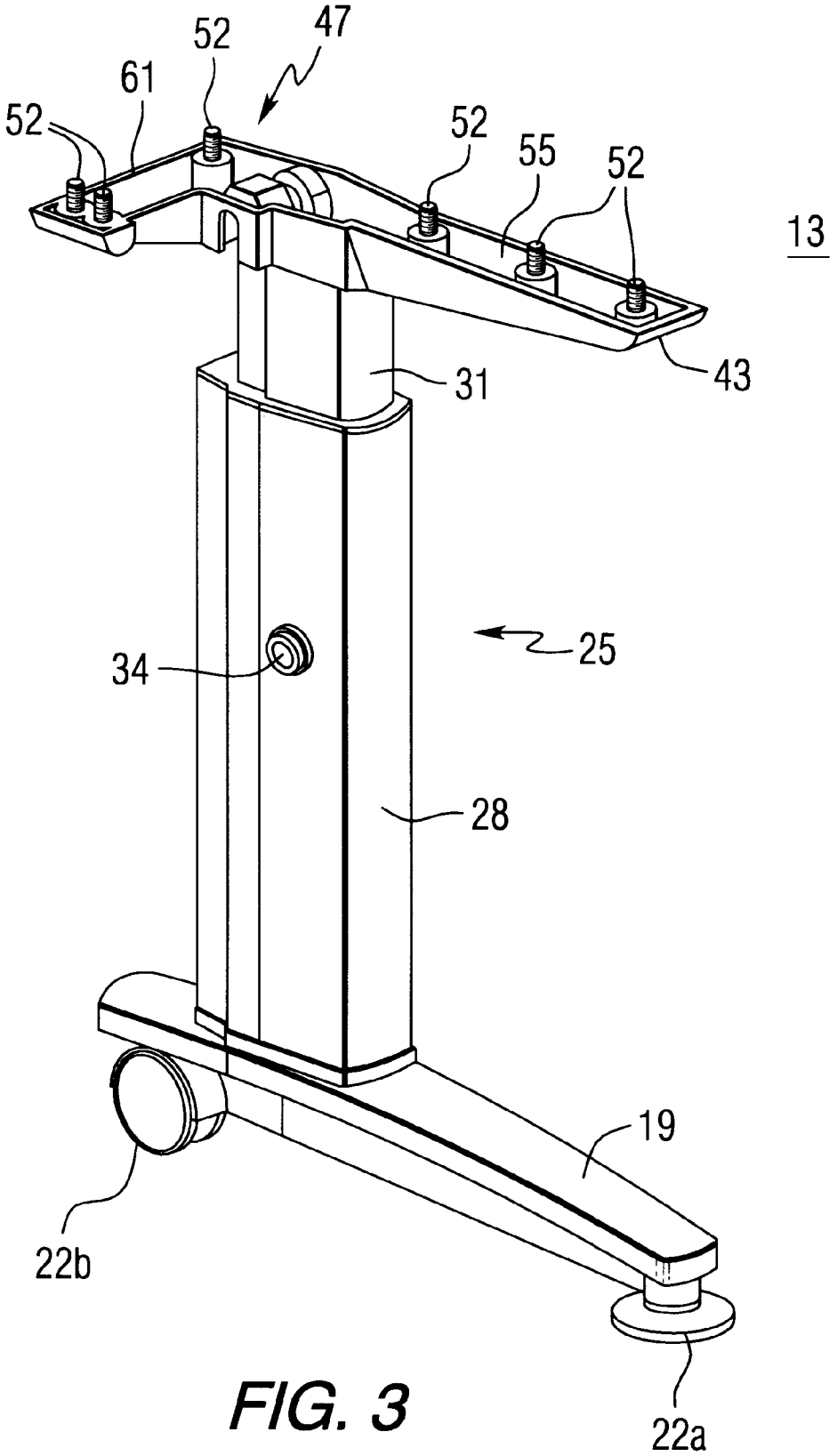
FIG. 3 is a perspective view of a cantilevered support leg having the L-shaped attachment bracket according to the present invention.

Referring now to the drawings in detail, wherein like reference characters correspond to similar elements, FIG. 2 shows a perspective view of a height adjustable desk 10 having a pair of cantilevered support legs 13 according to the present invention. As shown therein, the height adjustable desk comprises a generally rectangular and horizontal work surface 16 supported by a pair of cantilevered support legs 13 disposed on either lateral end 17, 18 of the desk top. The cantilevered support legs are shown in more detail in FIGS. 3 and 4. As shown therein, each cantilevered support leg 13 comprises a horizontal foot 19 which rests on the floor at two widely spaced points 22*a*, 22*b*. Vertically extending from each foot is a height adjustable leg 25 which preferably comprises two telescoping elements. The fixed support mechanism 28, which does not move, is rigidly connected to the foot 19 such as by screws or the like in a manner well known in the art. A telescoping portion 31 is slidably connected to the fixed support 28 so as to provide the vertical height adjustment. The telescoping portion 31 is vertically movable with respect to the rigid support and is preferably held in place by a pin 34 passing through a hole 37 in the fixed support 28 and which can be engaged with a number of corresponding openings 40 in the telescoping portion 31. By removing the pin 34 and sliding the telescoping portion 31 up or down with respect to the fixed support leg 28, the height adjustment of the work surface can be accomplished. The telescoping portion 31 can either slide within the fixed support 28, as shown, or the fixed support can slide into the telescoping portion. Height adjustment can also be accomplished by numerous other means well known in the art.

Figure 4:
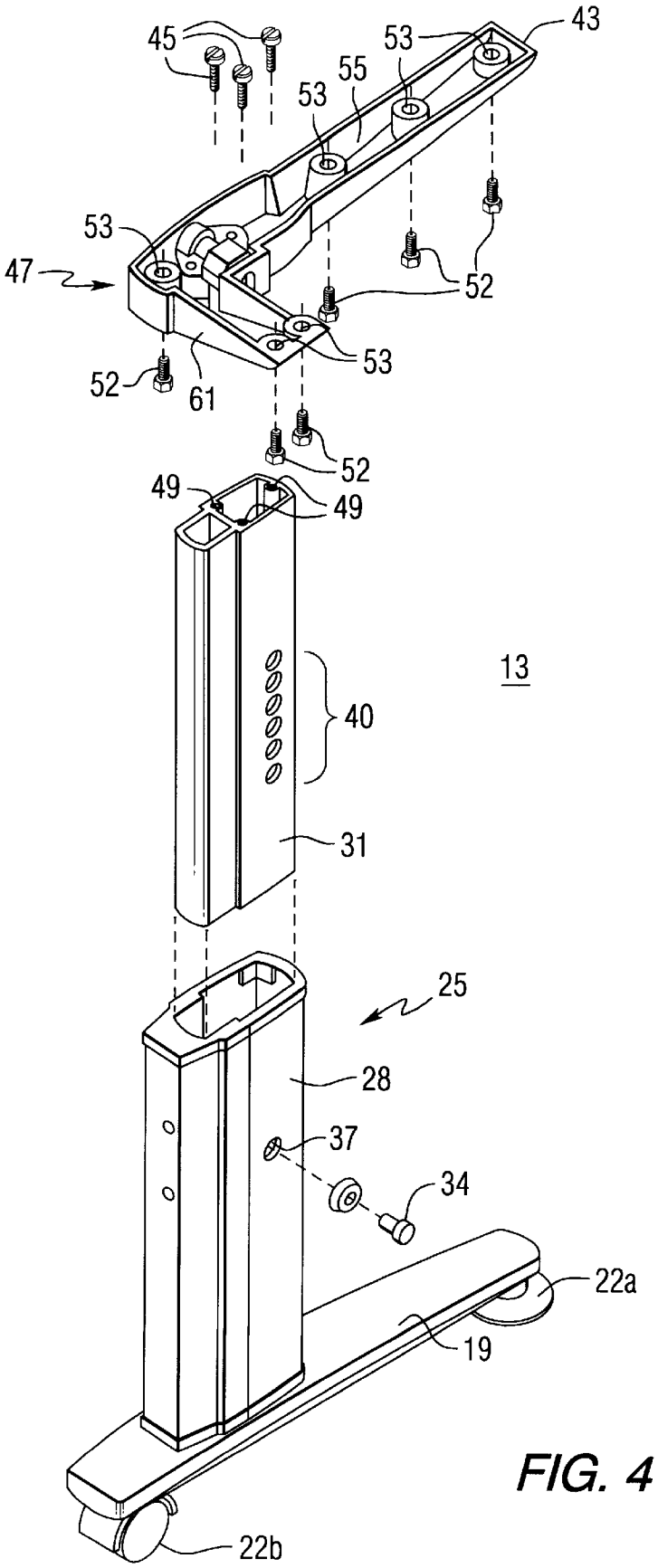
FIG. 4 is an exploded view of the cantilevered leg assembly showing the main constituent parts thereof.

Connected to the telescoping portion 31 is an L-shaped support bracket 43 according to the present invention (see FIG. 4). Preferably, three screws 45 pass or are threaded through openings (not shown) in the L-shaped support bracket 43 adjacent its right angle connections 47 and threadingly engage corresponding holes 49 in the telescoping portion 31. Each of the cantilevered support legs 13 is connected to the underside 51 of the work surface 16 by bolts or screws 52 passing through holes 53 in the support bracket 43, six being shown in the figure. Thus, the support bracket of the present invention is movable with the desk top as its height is adjusted.

Each support leg 13 is connected to the work surface 16 by the L-shaped support bracket 43 which has a first primary support arm 55 which provides a cantilever support for the work surface. As shown, four screws 52 are preferably used to secure the primary support arm 55 to the underside 51 of the desk top. A secondary support arm 61 is provided on the bracket 46, preferably oriented toward the back edge 64 of the work surface offset from the primary support arm 55, and preferably extends perpendicularly with respect thereto. Typically, two screws 49 are used to attach the secondary support arm 61 to the underside 51 of the work surface 16. In this manner, each arm 55, 61 of the L-shaped bracket 43 is positioned such that the right angle connection 47 of each of the respective support arms extend substantially parallel to and adjacent the rear corners 67 of the work surface, so that the width and depth of the unobstructed area underneath the desk is maximized. Although an L-shaped support is shown in which the secondary support arm 61 is relatively shorter than the primary support arm 55, it is to be understood that the arms can be of equal length or the secondary arm can be the longer arm.

By providing the offset laterally extending secondary support arm 61 on each of the cantilever brackets 43, the support legs help to transmit any lateral forces acting on the legs to the desk top. Thus, additional support is provided for the cantilevered support leg 13 so as to prevent stripping out of the screws 52 from the underside 51 of the desk top 16 as can happen with conventional support legs not having any other lateral support for the legs. In this manner, a relatively thin cantilever primary support arm 55, as is provided in the prior art to maximize the space underneath the desk, can be provided but also, by providing the offset secondary support arm 61, lateral support can be provided towards the back edge 64 of the work surface without the need for an additional stretcher. The L-shaped bracket provides an asymmetric buttress for the work surface with respect to the support legs while maximizing the area under the desk. In this manner, accessory office components such as a pedestal including file cabinets 70, for example, can be made as large as possible to fit in the area underneath the desk top.

Figure 5:
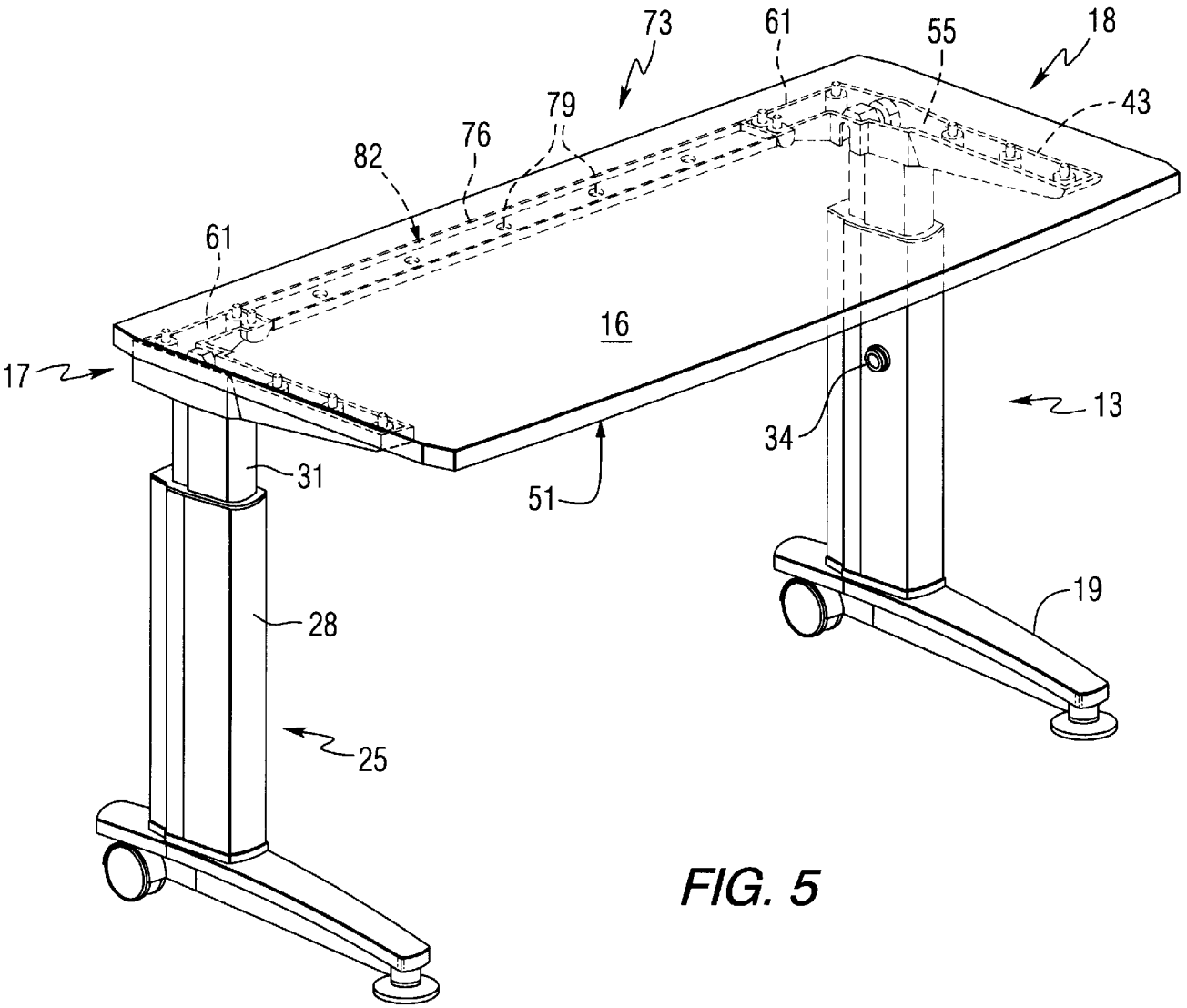
FIG. 5 is a perspective view of an alternate embodiment of the present invention having a generally U-shaped support for a desk top.

In another embodiment shown in FIG. 5, in order to provide additional support, such as for a desk 73 which is to be generally overloaded with equipment, it may be desirable to add a third support arm 76 or lateral support bracket which effectively connects the two secondary support arms 61 of the L-shaped bracket 43. In this embodiment, an additional lateral support is connected to each of the secondary support arms and the desk top by screws which pass through the holes 79 in the secondary support and complimentary holes in the lateral support bracket 76. In this manner, a generally U-shaped support bracket 82 is provided underneath the work surface which still maximizes the space available for accessory equipment. Alternatively, a one piece U-shaped bracket can be provided which can be attached to the telescoping portion 31 of each of the support legs 13 and then screwed or bolted to the underside of the desk top 16 , as are the separate three components hereinbefore described. As a further alternate embodiment of the invention for providing a generally U-shaped support bracket on the underside of the desk top, a cantilever support bracket similar to those used in the art can be provided. However, the rear portion of each is modified so as to have secured thereto the third lateral support which is rigidly connected to each of the cantilevered support brackets to provide the generally U-shaped support, as is connected to the secondary support arms discussed above.

An advantage of the U-shaped support bracket 82 is that the third support arm 76 can provide additional functions. For example, the third support arm can be made in the shape of a channel for accommodating wires, as part of a wire management system. In this way, the wire management channel is movable with the desk top when its height is adjusted, since the bracket is connected to the telescoping portion and the underside of the work surface. Another function that can be performed by the third support arm is to reinforce the work surface so that it can support greater weight.

The L-shaped support bracket 43 on either lateral end of the desk top, with the secondary support arms 61 disposed perpendicularly with respect to the primary cantilever support arms 55, resist side loading of the support legs 13 without requiring a horizontal beam element rigidly connected between a lower portion of each support leg, as is typical in the prior art. Thus, a work desk can be built without a horizontal brace or beam which takes up valuable space underneath the desk. Lateral support is provided for the legs by rigidly securing the legs in two perpendicular directions immediately underneath the work surface.

Thus the necessary support structure is provided with the L-shaped support bracket for the cantilevered support leg of the present invention while maximizing space availability underneath the work surface. Preferably the support bracket 43 is made of a one-piece die cast aluminum for a one piece support. By resisting lateral forces, the telescoping portion 31 of the height adjustable leg 25 does not bind with respect to the fixed support 28 such that the height adjustment for the work surface can be readily accomplished. The L-shaped support brackets of each of the cantilevered support legs allows any lateral load to be shared by both legs by transferring such side loading through the desk top, further buttressing the legs with respect to the work surface, and counteracting any lateral forces either impinging directly on the legs themselves or which would cause the legs to splay outward under a fully loaded desk.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

We claim:

1. A desk comprising:

a generally horizontal work surface having a rectangular shape and a pair of rear corners on opposed lateral ends thereof and an underside;

a pair of support legs connectable to the underside, one on each of said opposed lateral ends at the rear corners thereof, each of said support legs further comprising:

a generally horizontal foot;

a vertical support leg projecting upward from a back portion of the horizontal foot;

an L-shaped cantilever support bracket connected to the vertical support leg and secured to the underside of the work surface, said L-shaped cantilever support bracket having a primary support arm generally parallel with the horizontal foot and a secondary support arm generally angularly offset with respect to the primary support arm; and wherein one said L-shaped cantilever support bracket is generally aligned with one of said rear corners and another said L-shaped cantilever support bracket is generally aligned with the other said rear corner.

2. The desk of claim 1, wherein the secondary support arm of each of said L-shaped support brackets is generally perpendicularly oriented with respect to the primary support arm such that they project inward with respect to said opposed lateral ends of the work surface.

3. The desk of claim 1, wherein the cantilever support bracket of each of said support legs is connected to the underside of the work surface by a plurality of screws.

4. The desk of claim 1, wherein the vertical support leg of each of said support legs further comprises a telescoping portion whereby the desk is height adjustable.

5. The desk of claim 1, wherein the vertical support leg of each of said support legs comprises a first portion fixedly secured to the generally horizontal foot and projecting upward therefrom, a telescoping portion slidably connected to the first portion, the cantilever support bracket being secured to the telescoping portion whereby the generally horizontal work surface is height adjustable.

6. The desk of claim 5, wherein the secondary support arm of each of said support legs is generally perpendicularly oriented with respect to the primary support arm such that they project inward with respect to said opposed lateral ends of the work surface.

7. The desk of claim 6, wherein the horizontal work surface is rectangular, such that the work surface has a pair of rear corners, one on each of said opposed lateral ends, and the cantilever support bracket connected to each of said vertical support legs has an L-shape, wherein a corner of each of said L-shaped support brackets is generally aligned with each of said rear corners.

8. A cantilever support leg for a height adjustable desk, the cantilever support leg comprising:

a generally horizontal foot;

a vertical support leg projecting upward from a back portion of the horizontal foot; and an L-shape cantilever support bracket connected to the vertical support leg, said cantilever support bracket having a primary support arm being a longer portion of the L-shape and generally parallel with the horizontal foot and a secondary support arm being a shorter portion of the L-shape, wherein each of said primary and secondary support arms are connected to each other by a right angle connection.

9. The cantilever support leg as recited in claim 8, wherein the vertical support leg comprises a first portion fixedly secured to the generally horizontal foot and projecting upward therefrom, a telescoping portion slidably connected to the first portion, the cantilever support bracket being secured to the telescoping portion.

10. The cantilever support leg as recited in claim 9, wherein the secondary support arm extends generally perpendicularly with respect to the primary support arm such that the support bracket has an L-shape, wherein each of said arms are connected to each other by a right angle connection.

11. The cantilever support leg as recited in claim 8, wherein the vertical support leg further comprises a telescoping portion.

12. A freestanding height adjustable desk comprising:

a generally rectangle work surface having a pair of rear corners and an underside and a pair of support legs connectable to the underside on opposed lateral ends thereof, each of said support legs further comprising:

a generally horizontal foot;

a vertical support leg projecting upward from a back portion of the horizontal foot; and an L-shaped cantilever support bracket connected to the vertical support leg and secured to respective ones of said opposed lateral ends on the underside of the rectangular work surface, said L-shaped cantilever support bracket having a primary support arm generally parallel with the horizontal foot and a secondary support arm generally perpendicular to the primary support arm, wherein the secondary support arm of each of said support legs is oriented with respect to the primary support arm such that a corner of each of said L-shaped support brackets is generally aligned with each of said rear corners.

13. The freestanding height adjustable desk as recited in claim 12, wherein the vertical support leg of each of said support legs comprises a first portion fixedly secured to the generally horizontal foot and projecting upward therefrom, a telescoping portion slidably connected to the first portion, the cantilever supporting bracket being secured to the telescoping portion whereby the generally horizontal work is height adjustable.

14. The freestanding height adjustable desk as recited in claim 12, further comprising a third support arm rigidly secured to each of said secondary support arms.

15. A freestanding height adjustable desk comprising:

a generally rectangular work surface having a front portion, a rear portion and an underside;

a pair of support legs connectable to the underside on opposed lateral ends thereof, each of said support legs further comprising a generally horizontal foot and a vertical support leg projecting upward from a back portion of the horizontal foot; and a one-piece U-shaped support bracket connected to each of said support legs and secured to said opposed lateral ends on the underside of the work surface, the U-shaped support bracket having two primary arms secured to the vertical support leg and a secondary support arm connecting said primary arms and disposed along the rear portion of the rectangular work surface.

16. The freestanding height adjustable desk as recited in claim 15 wherein the vertical support leg of each of said support legs comprises a first portion fixedly secured to the generally horizontal foot and projecting upward therefrom, a telescoping portion slidably connected to the first portion, said primary arms of said U-shaped support bracket being secured to each telescoping portion whereby the generally rectangular work surface is height adjustable.

17. The freestanding height adjustable desk as recited in claim 15, wherein the secondary support arm comprises a channel for storing wires therein.

18. The freestanding height adjustable desk as recited in claim 15, wherein the secondary support arm is adapted to support the work surface.

19. The freestanding height adjustable desk as recited in claim 15, wherein said primary support arms have an L-shape.

* * * * *

UNITED STATES PATENT AND TRADEMARK OFFICE

CERTIFICATE OF CORRECTION

PATENT NO. : 6,029,587

DATED : February 29, 2000

INVENTOR(S) : CHARLES P. ROZIER, JR., MICHAEL L. MCALLISTER

It is certified that error appears in the above-indentified patent and that said Letters Patent is hereby corrected as shown below:

Column 7, line 15, claim 12, change "rectangle" to --rectangular--.

Column 7, line 39, claim 13, change "supporting" to --support--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*